US007230376B2

(12) United States Patent
Yoo et al.

(10) Patent No.: US 7,230,376 B2
(45) Date of Patent: Jun. 12, 2007

(54) PLASMA DISPLAY PANEL HAVING SEALING STRUCTURE FOR REDUCING NOISE

(75) Inventors: Hun-Suk Yoo, Asan (KR); Tae-Kyoung Kang, Asan (KR)

(73) Assignee: Samsung SDI Co., Ltd., Suwon (KR)

( * ) Notice: Subject to any disclaimer, the term of this patent is extended or adjusted under 35 U.S.C. 154(b) by 294 days.

(21) Appl. No.: 10/720,191

(22) Filed: Nov. 25, 2003

(65) Prior Publication Data

US 2004/0104674 A1 Jun. 3, 2004

(30) Foreign Application Priority Data

Nov. 26, 2002 (KR) ..... 10-2002-0073949

(51) Int. Cl.
*H01J 17/49* (2006.01)
*H01J 9/32* (2006.01)

(52) U.S. Cl. ..... 313/582; 313/495; 313/584; 445/24; 445/25

(58) Field of Classification Search ..... 313/582; 445/24, 25
See application file for complete search history.

(56) References Cited

U.S. PATENT DOCUMENTS 5,985,069 A * 11/1999 Kawabe et al. ..... 156/109
6,479,944 B2 * 11/2002 Lee et al. ..... 315/169.4
6,495,262 B2 * 12/2002 Igeta ..... 428/426
6,545,410 B1 * 4/2003 Wu et al. ..... 313/582
6,809,476 B2 * 10/2004 Lee et al. ..... 313/581
6,817,917 B1 11/2004 Kado et al. ..... 445/25
2004/0056597 A1 * 3/2004 Ko et al. ..... 313/582

FOREIGN PATENT DOCUMENTS

JP 2001-222952 8/2001
JP 2001319583 A * 11/2001
JP 2003-221260 8/2003
KR 10-2001-0074772 9/2001
KR WO 02/75766 A1 * 2/2002

* cited by examiner

*Primary Examiner*—Sikha Roy
(74) *Attorney, Agent, or Firm*—H.C. Park & Associates, PLC

(57) ABSTRACT

A plasma display panel reduces noise caused by the formation of minute gaps between the first substrate and the second substrate. The plasma display panel includes a first substrate and a second substrate opposing one another with a predetermined gap therebetween, and a sealant formed on opposing surfaces of the first substrate and the second substrate. The sealant is formed around outer circumferential areas of the first substrate and the second substrate to seal the first substrate and the second substrate together. The sealant is formed of regions having a first width of substantially the same size and of regions having a second width greater than the size of the first width.

8 Claims, 4 Drawing Sheets

PLASMA DISPLAY PANEL HAVING SEALING STRUCTURE FOR REDUCING NOISE

CROSS REFERENCE TO RELATED APPLICATION

This application is based on Korean Patent Application No. 2002-0073949 filed on Nov. 26, 2002 in the Korean Intellectual Property Office, the content of which is incorporated herein by reference in its entirety.

BACKGROUND OF THE INVENTION (a) Field of the Invention

The present invention relates to a plasma display panel, and more particularly, to a structure for joining substrates of a plasma display panel.

(b) Description of the Related Art

Flat panel displays are used for wall-mounted televisions, computer screens, and other such display applications. Among the different types of flat panel displays, the plasma display panel (PDP) is emerging as one of the most promising flat panel display configurations. Predetermined images are realized by the PDP by a discharge mechanism occurring in discharge cells.

As with other flat panel displays, such as, vacuum fluorescent displays and field emission displays, PDPs include two substrates (hereinafter referred to as an upper substrate and a lower substrate) which are provided substantially in parallel with each other and with a predetermined gap therebetween. The substrates define an exterior of the display device. A sealant is provided around an outer circumference of opposing surfaces of the substrates to join the substrates together. Air is evacuated from between the substrates in order to obtain a vacuum assembly.

The sealant is typically made of a sealant glass, or frit. During manufacture of the PDP, the sealing process is performed by subjecting the substrates with the frit therebetween in an environment with a temperature that is higher than a temperature corresponding to a softening point of the frit to thereby seal the substrates. A predetermined pressure (e.g., 1~2 kg/cm$^2$) may be applied to an exterior of the substrates to realize more effective sealing. Such a pressure may be applied, for example, by a plurality of sealant clips that apply pressure to the substrates.

As an example of a technique for sealing a PDP, a sealing method for a PDP is disclosed in Korean Laid-Open Patent No. 2001-0004156. However, as disclosed in the patent, in the sealing process of flat panel displays, including PDPs, there is a high probability that minute leaks will occur at portions of the sealant area because of the joining characteristics of the frit and the upper and lower substrates.

Such a problem may be attributed to the state of deposition of the frit on the substrates. That is, the frit is generally deposited, with a uniform thickness, around the circumference of the substrates. No steps are taken to vary the thickness of the frit at specific areas, such as, the areas where the sealant clips are provided. As a result, the thickness of the frit varies in the regions where the sealant clips are mounted on the substrates.

In particular, the frit in the region where the sealant clips are provided becomes thinner than the frit where the sealant clips are not provided (a difference of approximately 20~40 μm results). If minute gaps are formed, as a result of this difference in frit thickness in the regions where the substrates are sealed, noise is generated during operation of the PDP. This reduces the overall quality of the PDP.

SUMMARY OF THE INVENTION

In one embodiment, the invention provides a plasma display panel that substantially prevents the formation of minute gaps in a sealing area between substrates to thereby reduce noise caused by such minute gaps.

The plasma display panel includes a first substrate and a second substrate opposing one another and with a predetermined gap therebetween. A sealant is formed on opposing surfaces of the first substrate and the second substrate around outer circumferential areas of the first substrate and the second substrate to seal the first substrate and the second substrate. The sealant is formed of regions having a first width of substantially the same size and of regions having a second width greater than the size of the first width.

In various embodiments according to this invention, the plasma display panel includes a first substrate and a second substrate which oppose one another with a predetermined gap therebetween, and a sealant which is formed on opposing surfaces of the first substrate and the second substrate around outer circumferential areas of the first substrate and the second substrate to seal the first substrate and the second substrate. The cross-section of sealant is band-shaped with a plurality of nodes.

The invention separately provides a method for sealing a first substrate of a plasma display panel with a second substrate of the plasma display panel, the method comprising depositing a sealant along an outside border of the first substrate, wherein the sealant is deposited on a surface of the first substrate which opposes the second substrate and the sealant has a first width, which is substantially uniform, in a plurality of first areas and the sealant has a second width in second areas.

BRIEF DESCRIPTION OF THE DRAWINGS

The accompanying drawings, which are incorporated in and constitute a part of the specification, illustrate an exemplary embodiment of the invention, and, together with the description, serve to explain the principles of the invention.

DETAILED DESCRIPTION OF THE PREFERRED EMBODIMENTS

An exemplary embodiment of the present invention will now be described in detail with reference to the accompanying drawings. It should be understood that the structure of the present invention is useful not only for plasma display panels, but also for similar flat panel displays, such as vacuum fluorescent displays.

Figure 1:
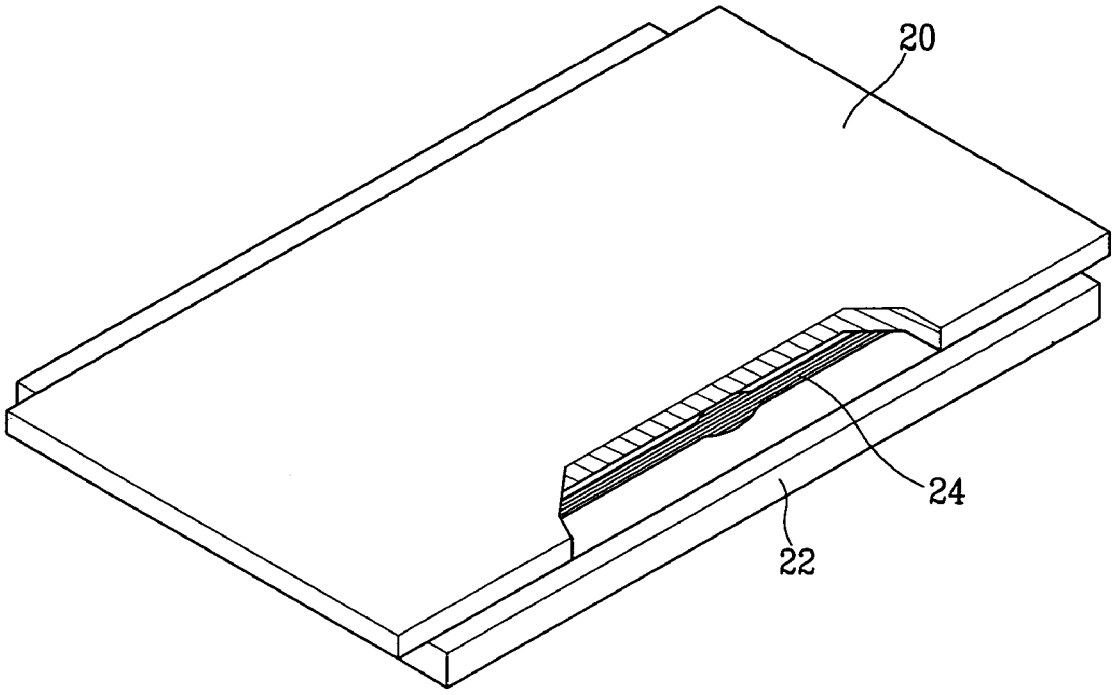
FIG. 1 is a partial cutaway perspective view of a plasma display panel according to an embodiment of the present invention.

FIG. 1 is a partial cutaway perspective view of a plasma display panel according to an embodiment of the invention. As shown in the drawing, the plasma display panel (PDP) includes a first substrate (or upper substrate) 20 and a second substrate (or lower substrate) 22 provided substantially parallel with each other and with a predetermined gap therebetween. Also, various structural elements are provided between the first substrate 20 and the second substrate 22 for realizing the display of predetermined images according to operation of a discharge mechanism. More particularly, for example, mounted between the first substrate 20 and the second substrate 22 are barrier ribs for forming discharge cells, discharge sustain electrodes and address electrodes to which voltages needed for discharge are applied, phosphor layers, and a dielectric layer.

Generally, the first substrate 20 and the second substrate 22 are substantially rectangular, and thus have long sides and short sides. A sealant 24 is deposited on outer circumference areas of at least one of the first substrate 20 and the second substrate 22. In particular, the sealant 24 is deposited on the outer circumference of at least one of the first substrate and the second substrate at portions of the substrate which oppose a surface of the other substrate. The first substrate 20 and the second substrate 22 are then attached to one another through a sealing process to thereby form the exterior of the PDP.

Figure 2:
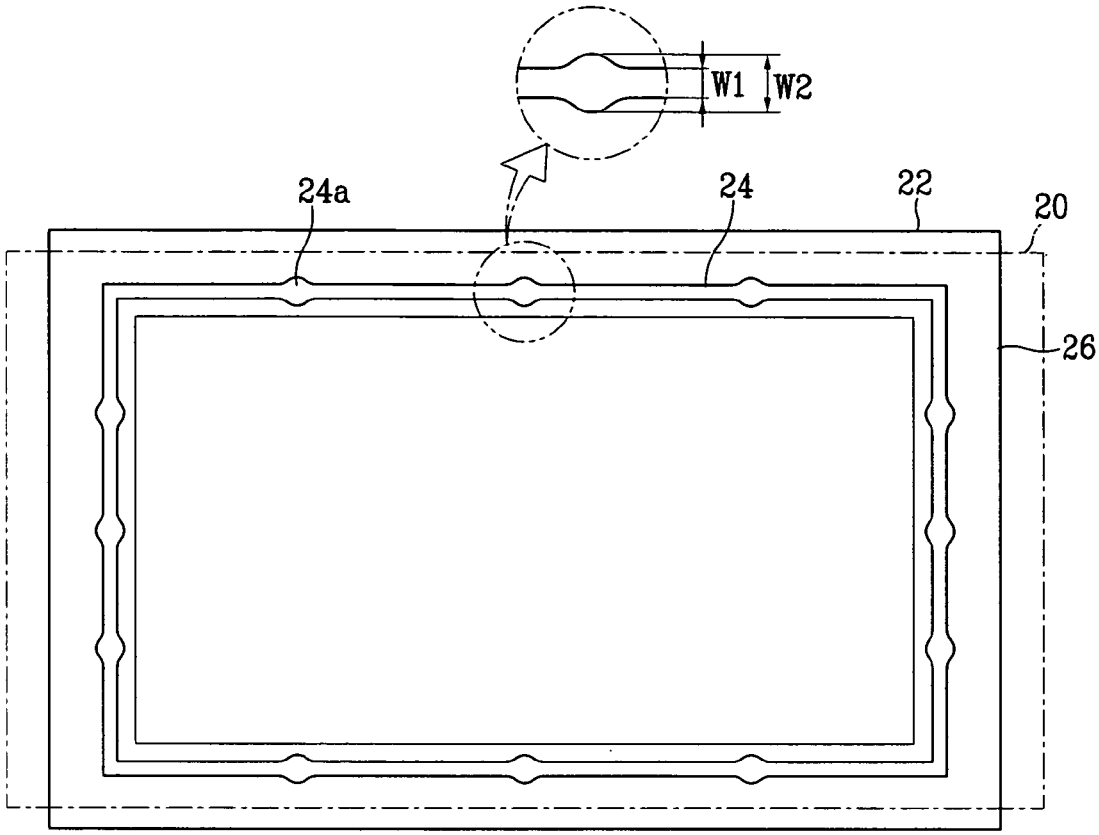
FIG. 2 is a plan view of a plasma display panel according to an embodiment of the present invention.

With reference also to FIG. 2, the sealant 24 is deposited in a non-display region 26 of the panel and in a substantially rectangular shape. Generally, the sealant 24 is deposited in a shape which corresponds to the configuration of the first substrate 20 and the second substrate 22. The sealant 24 is typically realized using frit, which is fused glass. In the present invention, following the sealing process of the PDP, a final form of the sealant 24 is realized, as described below, to prevent minute gaps from forming between the first substrate 20 and the second substrate 22.

Figure 3:
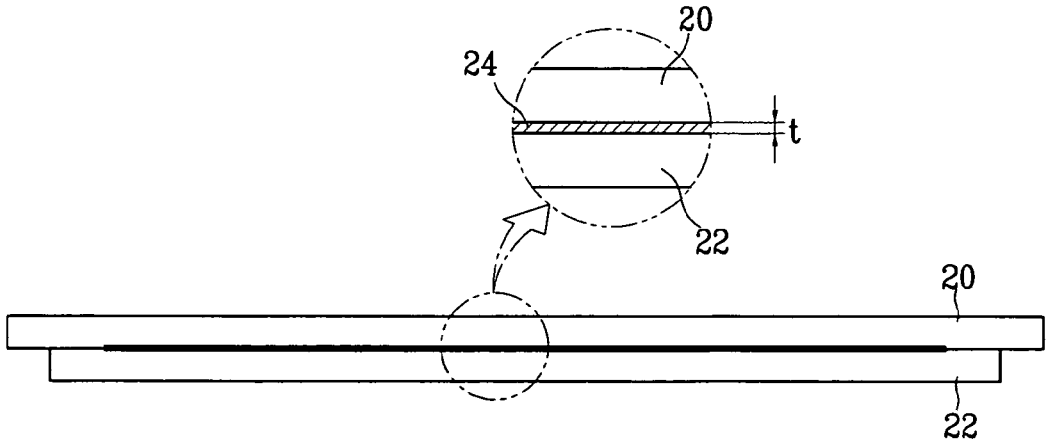
FIG. 3 is a front view of a plasma display panel according to an embodiment of the present invention.

Referring to FIG. 3, the sealant 24 has a predetermined thickness (t) between the first substrate 20 and the second substrate 22. However, when viewed from above, as in FIG. 2, there are areas of the sealant 24 having a width w2 that is greater than a width w1 of other areas of the sealant 24. That is, the sealant 24 is formed having the width w1, and a plurality of nodes 24*a* are formed at predetermined areas of the sealant 24. At the nodes 24*a*, the sealant has a width w2, which is greater than the width w1.

The nodes 24*a*, having the width w2, gradually increase in size to have a peak width w2, and then gradually decrease in size until they have a width w1. However, the present invention is not limited to such a configuration and other various shapes may be used.

In the various embodiments of this invention, the nodes 24*a* having the width w2 are located at areas which correspond to areas where pressure is applied to the first substrate 20 and the second substrate 22 during the sealing operation. That is, the nodes 24*a* preferably correspond to areas where the sealant clips are mounted on the first substrate 20 and the second substrate 22.

The sealing of the first substrate and the second substrate 22 will now be described with reference to FIGS. 4, 5, and 6.

Figure 4:
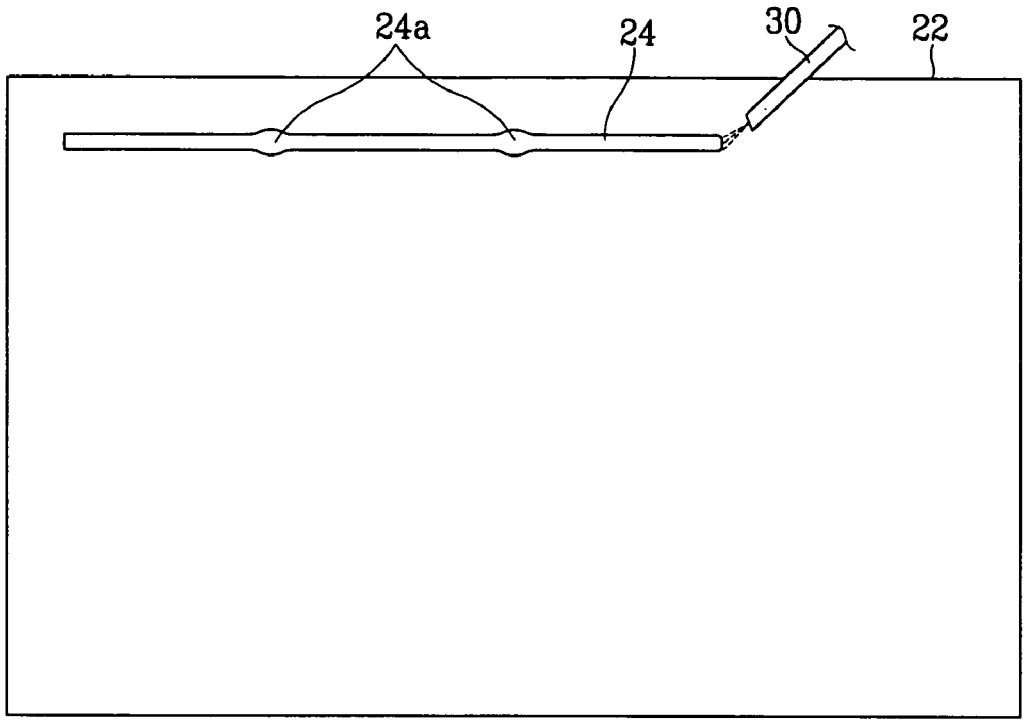
FIGS. 4, 5, and 6 are schematic views used to describe a sealing process of a plasma display panel according to an embodiment of the present invention.

First, with reference to FIG. 4, the sealant 24 is deposited on the outer circumferential area of at least one of the first substrate 20 and the second substrate 22 on which the various structural elements are formed for displaying images (i.e., the discharge sustain electrodes, address electrodes, phosphor layers, and dielectric layer). The second substrate 22 is arbitrarily chosen to illustrate the process. The sealant 24 is deposited, for example, by a general adhesive deposition method using a dispenser 30 or by a screen printing method.

During deposition of the sealant 24 on predetermined areas of the substrate, the sealant 24 is deposited with a greater width than the remaining areas of the sealant 24. By depositing the sealant 24 with a greater width in some areas, the nodes 24*a* are formed. Such control of widths is realized, for example, by varying an injection speed of the dispenser 30 and by controlling paste injection amount of the frit.

Figure 5:
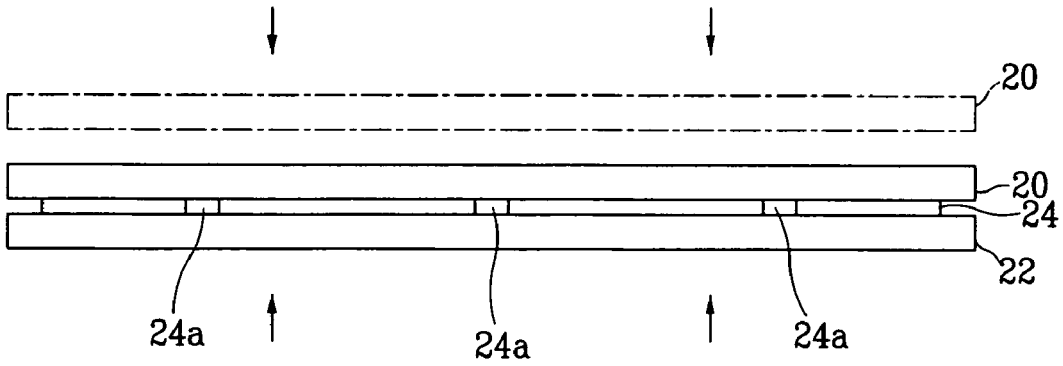
Figure 6:
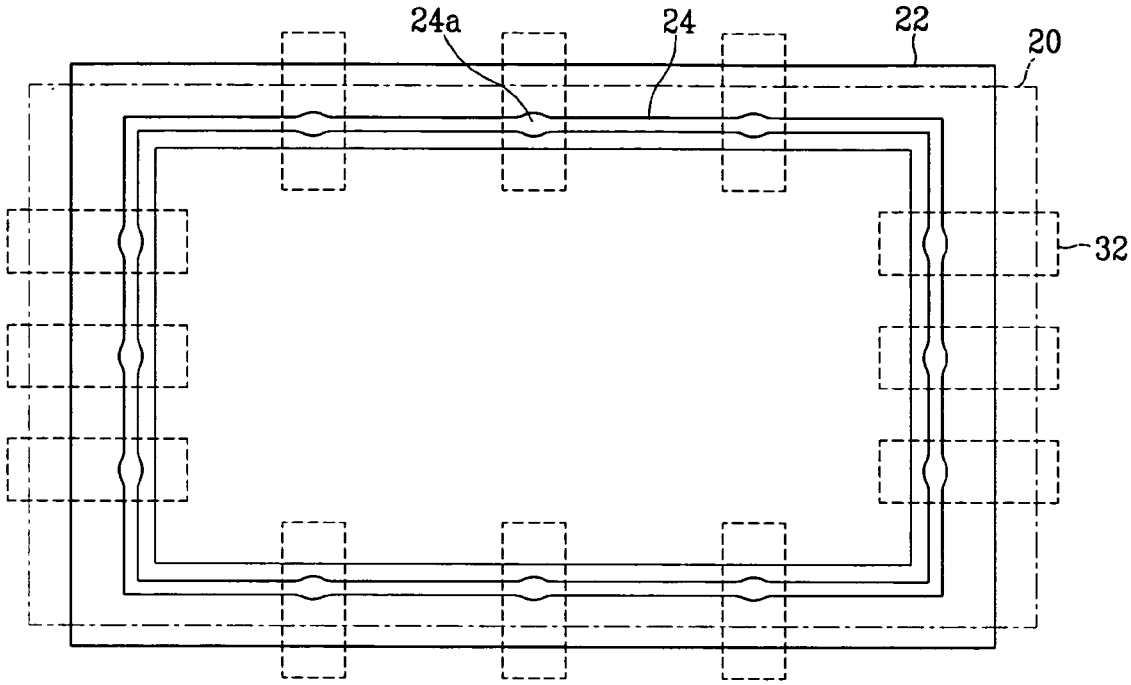

After depositing the sealant 24 on the second substrate 22, as described above, the first substrate 20 is placed on top of the second substrate 22, as shown in FIG. 5. The first substrate 20 and the second substrate 22 are then placed in an oven that is set at a temperature at or greater than the softening point of the sealant 24. By subjecting the first substrate 20 and the second substrate 22 to a temperature equal to or more than the softening point of the sealant, the first substrate 20 and the second substrate 22 may be sealed together. During this procedure, sealant clips 32 are mounted on the first substrate 20 and the second substrate 22 at areas corresponding to the positions of the nodes 24*a*. The sealant clips 32 improve the seal between the first substrate 20 and the second substrate 22.

If the first substrate 20 and the second substrate 22 are sealed through such a process, it can be expected that a thickness of the sealant 24 corresponding to where the sealant clips 32 are located (i.e., where the sealant clips 32 are applying pressure to the first substrate 20 and the second substrate 22) will be somewhat less than the thickness of the sealant 24 in other areas. However, in this invention, because these areas of the sealant 24 are formed with a greater width than the remaining areas of the sealant 24, the thickness at these areas (that is, at the nodes 24*a*) remains substantially the same as the other areas of the sealant 24. The result is that the thickness at substantially all areas of the sealant 24 is substantially uniform following the sealing operation.

Further, as a result of the substantially uniform thickness of the sealant 24, minute gaps are not formed between the first substrate 20 and the second substrate 22. Table 1 below shows the results of noise measurements taken with this invention and with the conventional PDP of the same basic type (in the conventional PDP, the sealant is deposited at a uniform width throughout its entire length). It is clear from the results of Table 1 that the PDP of this invention generates significantly less noise than the conventional PDP.

TABLE 1

| Frequency bandwidth | Present Invention (dB) | Prior Art (dB) |
|---|---|---|
| 2.0 kHz bandwidth | 9.7 | 15 |
| 2.5 kHz bandwidth | 13.4 | 20 |
| 3.15 kHz bandwidth | 13.9 | 17.6 |
| Entire audible sound bandwidth (50 Hz~8 kHz) | 22 | 27.3 |

It is to be noted that the sealant 24 of this invention exhibited variations in thickness of about 5 μm or less at different areas, while the sealant of the conventional PDP exhibited variations in thickness of about 20 μm and 40 μm.

In the panel displays according to this invention, as described above, the formation of minute gaps between the substrates is prevented by an improved sealing structure. Therefore, noise generated during operation of the panel as a result of such minute gaps is reduced and an improved panel is provided.

Although an exemplary embodiment of the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate opposing one another with a predetermined gap therebetween; and a sealant formed on opposing surfaces of the first substrate and the second substrate around an outer circumferential area of the first substrate and the second substrate to seal the first substrate and the second substrate, wherein the sealant is formed of regions having a first width of substantially the same size and regions having a second width, wherein the second width is greater than the first width, the sealant having a substantially uniform thickness, wherein the regions of the sealant having the second width are located at areas where a sealing pressure is concentrated.

2. The plasma display panel of claim 1, wherein a plurality of the regions of the sealant having the second width are formed at predetermined intervals around the circumferential areas of the first substrate and the second substrate.

3. The plasma display panel of claim 1, wherein when moving in one direction along a long axis of the sealant, regions of the sealant having the second width gradually increase in size from regions of the sealant having the first width until reaching the size of the second width, then the width of the sealant gradually decreases in size until it reaches the size of the first width.

4. The plasma display panel of claim 1, wherein the sealant is frit.

5. The plasma display panel of claim 1, wherein the regions of the sealant having the second width correspond to areas where sealant clips are mounted to the first substrate and the second substrate during a sealing process.

6. A plasma display panel, comprising:

a first substrate and a second substrate opposing one another with a predetermined gap therebetween; and a sealant formed on opposing surfaces of the first substrate and the second substrate around outer circumferential areas of the first substrate and the second substrate to seal the first substrate and the second substrate, the sealant formed having a substantially uniform thickness, wherein a cross-section of the sealant is band-shaped with a plurality of nodes, the nodes being located at areas where a sealing pressure is concentrated.

7. The plasma display panel of claim 6, wherein the nodes are formed at predetermined intervals around the circumferential areas of the first substrate and the second substrate.

8. The plasma display panel of claim 6, wherein the sealant is frit.

* * * * *